US010773133B2

(12) United States Patent
Fang

(10) Patent No.: US 10,773,133 B2
(45) Date of Patent: Sep. 15, 2020

(54) LEATHER-ADHERED BASEBALL/SOFTBALL AND MANUFACTURING METHOD THEREFOR

(71) Applicant: XIAMEN ZAIFENG SPORTING EQUIPMENT CO., LTD., Xiamen, Fujian (CN)

(72) Inventor: Wenji Fang, Fujian (CN)

(73) Assignee: XIAMEN ZAIFENG SPORTING EQUIPMENT CO., LTD., Xiamen (CN)

( * ) Notice: Subject to any disclaimer, the term of this patent is extended or adjusted under 35 U.S.C. 154(b) by 0 days.

(21) Appl. No.: 16/443,944

(22) Filed: Jun. 18, 2019

(65) Prior Publication Data

US 2019/0299065 A1 Oct. 3, 2019

Related U.S. Application Data

(63) Continuation-in-part of application No. PCT/CN2017/071153, filed on Jan. 13, 2017.

(30) Foreign Application Priority Data

Dec. 19, 2016 (CN) ..... 2016 1 1180004

(51) Int. Cl.
*A63B 37/12* (2006.01)
*A63B 45/00* (2006.01)
(Continued)

(52) U.S. Cl.
CPC ..... *A63B 45/00* (2013.01); *A63B 37/12* (2013.01); *A63B 37/14* (2013.01);
(Continued)

(58) Field of Classification Search
CPC ..... A63B 45/00; A63B 37/14; A63B 37/12; A63B 2209/00; A63B 2102/18; A63B 2037/125; A63B 1/00
(Continued)

(56) References Cited

U.S. PATENT DOCUMENTS 1,988,722 A * 1/1935 De Beer ..... A63B 37/00 473/598
2,325,128 A * 7/1943 Grady ..... A63B 37/00 473/597
(Continued)

FOREIGN PATENT DOCUMENTS

CN 2533910 Y 2/2003
CN 201211415 Y 3/2009
CN 102553182 A 7/2012

OTHER PUBLICATIONS

International search report of PCT Patent Application No. PCT/CN2017/071153 dated Sep. 29, 2017.

*Primary Examiner* — Steven B Wong

(57) ABSTRACT

A leather-adhered baseball/softball, comprises a ball core, and a wrapping layer formed over the ball core by a mold, wherein the mold is engraved with raised lines of baseball/softball stitches, such that the molded wrapping layer has a raised baseball/softball stitch guide; the baseball/softball stitch guide is used to align a ball leather, such that the ball leather is aligned and adhered onto the wrapping layer except the baseball/softball stitch guide by an adhesive, so as to form a baseball/softball cover having the baseball/softball stitch guide; or the ball leather is aligned and molded on the wrapping layer except the baseball/softball stitch guide by a mold from a formulated leather raw material, so as to form a baseball/softball cover having the baseball/softball stitch guide. Also disclosed is a method for manufacturing a leather-adhered baseball/softball.

10 Claims, 3 Drawing Sheets

(51) Int. Cl.
*A63B 37/14* (2006.01)
*A63B 102/18* (2015.01)

(52) U.S. Cl.
CPC ..... *A63B 2037/125* (2013.01); *A63B 2102/18* (2015.10); *A63B 2209/00* (2013.01)

(58) Field of Classification Search
USPC ..... 473/600–602
See application file for complete search history.

(56) References Cited

U.S. PATENT DOCUMENTS 2,645,487 A * 7/1953 Hawes ..... A63B 37/00 473/601
4,653,752 A * 3/1987 Miller ..... A63B 37/00 156/292
4,808,272 A * 2/1989 Molitor ..... A63B 37/12 205/70
4,822,041 A * 4/1989 Molitor ..... A63B 37/12 473/597
5,253,865 A * 10/1993 Kinnee ..... A63B 37/12 473/598
6,458,052 B1 * 10/2002 Pitsenberger ..... A63B 37/12 473/598
6,592,477 B1 * 7/2003 Yang ..... A63B 37/12 473/597
6,890,396 B1 * 5/2005 Lee ..... B29C 43/24 156/244.11
8,535,470 B2 * 9/2013 Chen ..... A63B 45/00 156/242
9,999,810 B2 * 6/2018 Fang ..... A63B 37/12
2013/0196067 A1 * 8/2013 Smith ..... B05D 5/06 427/322
2014/0066238 A1 * 3/2014 Smith ..... A63B 43/02 473/597
2016/0067576 A1 * 3/2016 Repasi ..... A63B 69/0002 473/598

* cited by examiner

LEATHER-ADHERED BASEBALL/SOFTBALL AND MANUFACTURING METHOD THEREFOR

CROSS REFERENCE TO RELATED APPLICATIONS

The present application is a Continuation-In-Part Application of PCT Application No. PCT/CN2017/071153 filed on Jan. 13, 2017, which claims the benefit of Chinese Patent Application No. 201611180004.8 filed on Dec. 19, 2016. All the above are hereby incorporated by reference.

TECHNICAL FIELD

The present invention relates to a ball sport apparatus, in particular to a leather-adhered baseball/softball and a manufacturing method therefor.

BACKGROUND ART

The baseball/softball described in this patent document refers to a baseball or softball.

The existing traditional baseball/softball is made of an inner ball core and an outer leather by hand-stitching; such a method is old and has a low output, and fewer and fewer people are willing to engage in traditional baseball/softball stitching, given that the current human cost is increasing, and people are increasingly pursuing a superior environment for their quality of life. The traditional hand-stitching work intensity is great; it requires long-term sedentary work and repeated needle hole threading on the ball leather by hands, which easily results in eye fatigue, back pain, and cracking of hands.

The existing traditional baseball/softball manufacturing process relates to the use of the leather to match the size of the ball core to design a cutter for cutting followed by manual stitching, which is affected by the peak season, and the slow manual working, difficulty in recruitment and high training cost will result in a low output and the difficulty in controlling the delivery period. Moreover, the hand-stitched ball leather, due to the tensile strength of a leather itself, and non-fit sizes of the ball leather and the ball core, easily results in poor results of expanded and cracked leathers, for example when a small ball core is matched with a too large ball leather, the leather will rise, resulting in unevenness and bad appearance; when the ball is played, deflection phenomena is resulted in due to the uneven surface; furthermore if the ball core is too large, and the ball leather is too small, the leather on both sides cannot be stitched, and a hand pulling force may result in ball leather fracturing, leading to scrapping. There are also traditional baseball stitches, which are mostly made of a cotton polyester or nylon wire material; because of the friction or speed, broken thread will be resulted in; if the hand stitch is broken, the ball leather will be separated from the ball core, and then this baseball/softball is also scrapped.

SUMMARY OF THE INVENTION

In order to solve the above technical problems, an object of the present invention is to provide a leather-adhered baseball/softball which is not made by hand stitching and which is superior in performance to a conventional leather-adhered baseball/softball and a manufacturing method therefor.

The technical solution is:

A leather-adhered baseball/softball, comprising a ball core, a wrapping layer being formed over the ball core by a mold, wherein said mold is engraved with raised lines of baseball/softball stitches, such that the molded wrapping layer has a raised baseball/softball stitch guide; the baseball/softball stitch guide is used to align a ball leather, such that the ball leather is aligned and adhered onto the wrapping layer except the baseball/softball stitch guide by an adhesive, so as to form a ball cover having the baseball/softball stitch guide.

A leather-adhered baseball/softball, comprising a ball core, a wrapping layer being formed over the ball core by a mold, wherein the mold is engraved with raised lines of baseball/softball stitches, such that the molded wrapping layer has a raised baseball/softball stitch guide; the ball leather is aligned and molded on the wrapping layer except the baseball/softball stitch guide by a formulated leather raw material by a mold, so as to form a baseball/softball cover having the baseball/softball stitch guide.

Further, the baseball/softball stitch guide has a color of the wrapping layer material after being subjected to a color adjustment and molding, or is colored by spray coating or printing.

Further, the material of the wrapping layer is a rubber material, and the wrapping layer is formed by wrapping over the mold using an oil press or a vulcanizer; or the material of the wrapping layer is a PU material, and the wrapping layer is formed by integral perfusion on the mold by a perfusion machine; or the material of the wrapping layer is a TPR, TPU, silica gel or EVA material, and the wrapping layer is formed by injecting molding on the mold by an injection molding machine.

Further, the adhesive is applied to the outside of the wrapping layer, and the ball leather is adhered onto the wrapping layer following the location of a jig in an oil pressing process; the oil press is adjusted to a threshold temperature and pressure such that the ball leather is embedded into the wrapping layer, until a complete fusion of the two is obtained; or the oil press is adjusted to another low threshold temperature such that the ball leather and the wrapping layer are let to be engaged with each other.

Further, the adhesive is applied to the outside of the wrapping layer, and the ball leather is fixed and adhered onto the wrapping layer by another mold, followed by vulcanization fusion in a vulcanizer, such that the adhesive forms a vulcanization melt layer for melt-adhering the wrapping layer and the ball leather.

Further, the adhesive comprises the component of a resin, a softening oil, zinc oxide, DM, and sulfur.

Further, the ball core is a rubber core, a PU core, a PVC core, a wood core or a ball core made of a mixture of different materials, or a ball core formed from a plurality of wound layers of wool, cotton or wires of different materials.

Further, the ball leather is adhered onto the wrapping layer in two or more pieces; or when the number of the ball leather pieces is relatively small, the ball leather is adhered by means of leather expansion.

Further, the material of the ball leather is a genuine leather or artificial leather, and the ball leather is punched by a cutting machine to form a ball leather for adhering to the wrapping layer.

Further, the baseball/softball stitch guide on the wrapping layer has stitch guide leaves higher than the adhesion position of the ball leather, and the portion between the two adjacent stitch guide leaves is in the same plane with the wrapping layer; the stitch guide leaves have a leaf stitch number of 88, 104 or 108.

Further, the ball leather has a toothed edge, and concave and convex edges of the toothed ball leather edge and the stitch guide leaves are inserted into and fitted with each other; the stitch guide leaves are inserted into the concave portions of the toothed edge of the ball leather, and the stitch guide leaves of the wrapping layer are higher than the adhesion position of the ball leather; the convex portions of the toothed edge of the ball leather are inserted into the portions between the two adjacent stitch guide leaves, and the portions between the two adjacent stitch guide leaves are in the same plane with the wrapping layer under the ball leather except the stitch guide; the number of the concave portions in the concave-convex edges of the toothed edge of the ball leather is the same as the leaf stitch number of the stitch guide leaves.

Further, a stitch guide strip on the baseball/softball stitch guide of the wrapping layer is of a strip shape with an arc edge, the strip-shaped stitch guide strip is higher than the wrapping layer at the adhesion position of the ball leather at the arc edge, the stitch guide leaves on the strip-shaped stitch guide strip are higher than the stitch guide strip, and the leaf stitch number of the stitch guide leaves is 88, 104 or 108.

Further, the ball leather has an edge of an arc shape; when the ball leather is adhered, the ball leather completely wraps the portion except the strip-shaped stitch guide strip; the strip-shaped stitch guide strip is slightly higher than the wrapping layer at the ball leather adhesion position, and when the ball leather is adhered, the strip-shaped stitch guide strip is in the same plan with the ball leather, except the stitch guide leaves portion.

A method for manufacturing a leather-adhered baseball/softball, comprising the steps of: placing the ball core and the wrapping layer materials into a mold for shaping, wherein the mold is engraved with raised lines of the baseball/softball stitches, so as to form a wrapping layer wrapping the ball core, the wrapping layer has a raised baseball/softball stitch guide, applying an adhesive to the wrapping layer, then aligning and adhering the ball leather on the wrapping layer except the baseball/softball stitch guide, then leaving same to stand and adhering or placing same into another mold or jig for shaping and then removing same.

The present invention includes the following advantageous effects of:

1. The baseball/softball of the invention has an added wrapping layer on the ball core, such that when the ball leather is adhered, the bonding between the ball leather and the wrapping layer is stronger and smoother, effectively preventing some uneven ball core surface, thus largely avoiding the effect on the quality and service life of the ball leather resulting from the appearance of air bubbles in the ball cover. Moreover, the specific baseball/softball stitch guide can be formed by engraving the mold with raised lines, and the baseball/softball stitch guide also allows an effective alignment of the adhesion of the ball leather; as a result, the ball is more similar to a traditional baseball in appearance, the ball leather and the ball core are better adhered functionally, and moreover, the wrapping layer has moisture-proof and anti-corrosive effects on the ball core.

2. The baseball/softball stitch guide on the wrapping layer of the ball core is integrally molded with the wrapping layer, which can effectively avoid: broken thread results from the friction or speed, when a traditional baseball is played, thus effectively avoiding that if the hand thread is broken, the ball leather will be separated from the ball core, then this baseball/softball is also scrapped, so the leather-adhered baseball/softball has a superior service life than a traditional baseball/softball.

3. The present leather-adhered baseball/softball, with respect to a traditional baseball/softball, has an added wrapping layer, and the leather-adhering on the wrapping layer replacing the original stitching process, the baseball softball stitch guide molded integrated with a wrapping layer replacing the stitching thread, such that the whole product is superior to a traditional baseball/softball, in terms of a stick and unsmooth hand feel, as well as product features, such as resilience, compression resistance and the number of hits. The present leather-adhered baseball/softball generally has the effect of a traditional baseball/softball in the sense of smell, touch and vision, and has a longer service life, superior performance and a better use effect.

DETAILED DESCRIPTION OF EMBODIMENTS

Figure 1:
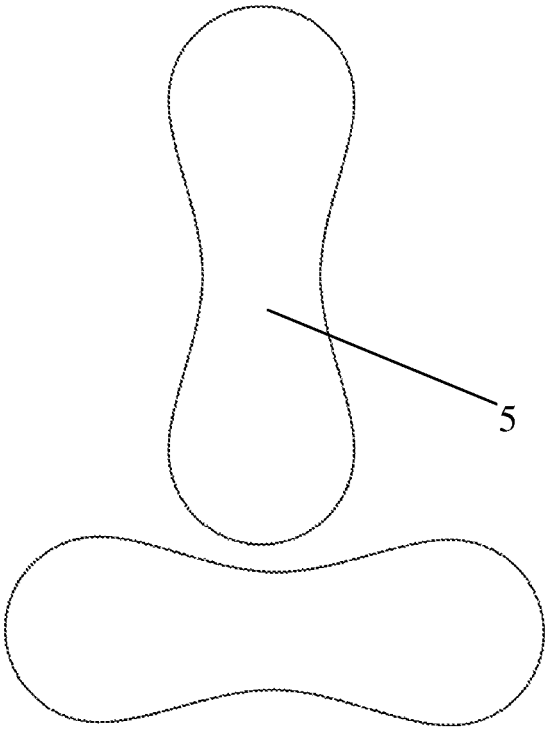
FIG. 1, a plane ball leather with an arc edge.

The present invention is described clearly and completely herebelow.

A leather-adhered baseball/softball, comprising a ball core, a wrapping layer being formed over the ball core by a mold, wherein the mold is engraved with raised lines of baseball/softball stitches, such that the molded wrapping layer has a raised baseball/softball stitch guide; the baseball/softball stitch guide is used to align a ball leather, such that the ball leather is aligned and adhered onto the wrapping layer except the baseball/softball stitch guide by an adhesive; the ball leather is also aligned and molded on the wrapping layer except the baseball/softball stitch guide by a formulated leather raw material by a mold, so as to form a baseball/softball cover having the baseball/softball stitch guide.

In the above, for the ball core:

The ball core can be a ball core with various weights, circumferences, compression resistance coefficients, and COR (Coefficient of Restitution) as required by customers, such as a rubber core, a PU core, a PVC core, a wood core or a ball core made of a mixture of different materials, or a ball core formed by a plurality of wound layers of wool, cotton or wires of different materials, as a ball core to be wrapped by a wrapping layer.

For the wrapping layer:

The wrapping layer can be made of various materials, such as a rubber, PU, PVC, TPU, EVA, etc., as long as the material can be tightly combined with the ball core. A variety of materials that can be used for effective wrapping for the ball core and the ball leather can be used to meet the different requirements of different customers. The wrapping layer is used for wrapping the ball core, and has moisture-proof and anti-corrosive effects on the ball core; when the wrapping layer is wrapped on a wood core, it can be waterproof and anti-oxidative, and effectively avoids corrosion or deterioration of the wood core due to moisture, and for the ball core wounded by materials, such as wool, the wrapping layer can also be effectively waterproof, avoiding the moisture absorption of the ball core due to moisture, and the deterioration of the ball's weight-bounce coefficient, as well as the adverse factors, such as reduction of the compression resistance and deformation; in short, the effective control of the circumference and weight of the baseball/softball can be effectively satisfied, and the number of hits is improved.

The formation of the wrapping layer requires the use of a mold, and the raised lines of the baseball/softball stitches engraved on the mold allow the wrapping layer having a raising effect. Wrapping layers of different materials need to be formed by different production apparatuses, for example, rubber requiring a vulcanizer, PU requiring an infusion machine, PVC and TPU requiring an injection molding machine, and various manufacturing processes for wrapping layers. When the material of the wrapping layer is a rubber material, the wrapping layer is formed by wrapping over the mold using an oil press or vulcanizer; when the material of the wrapping layer is a PU material, the wrapping layer is formed by integral perfusion on the mold by a perfusion machine; when the material of said wrapping layer is a PVC, TPU, TPR, silica gel or EVA material, and the wrapping layer is formed by injecting molding on the mold by an injection molding machine.

Figure 5:
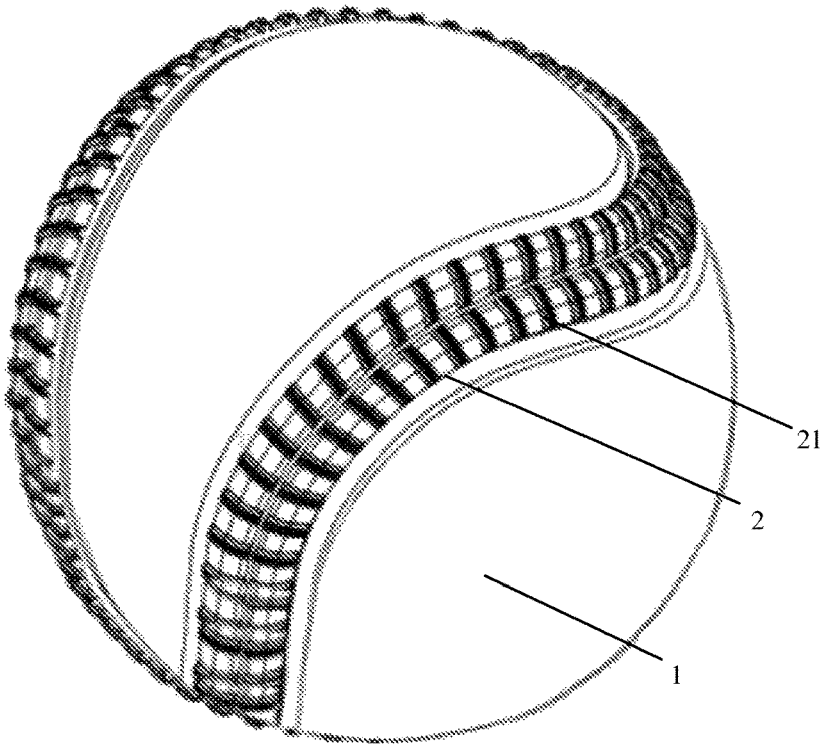
FIG. 5, a wrapping layer ball having a corresponding adhesion with a plane ball leather with an arc edge.
Figure 6:
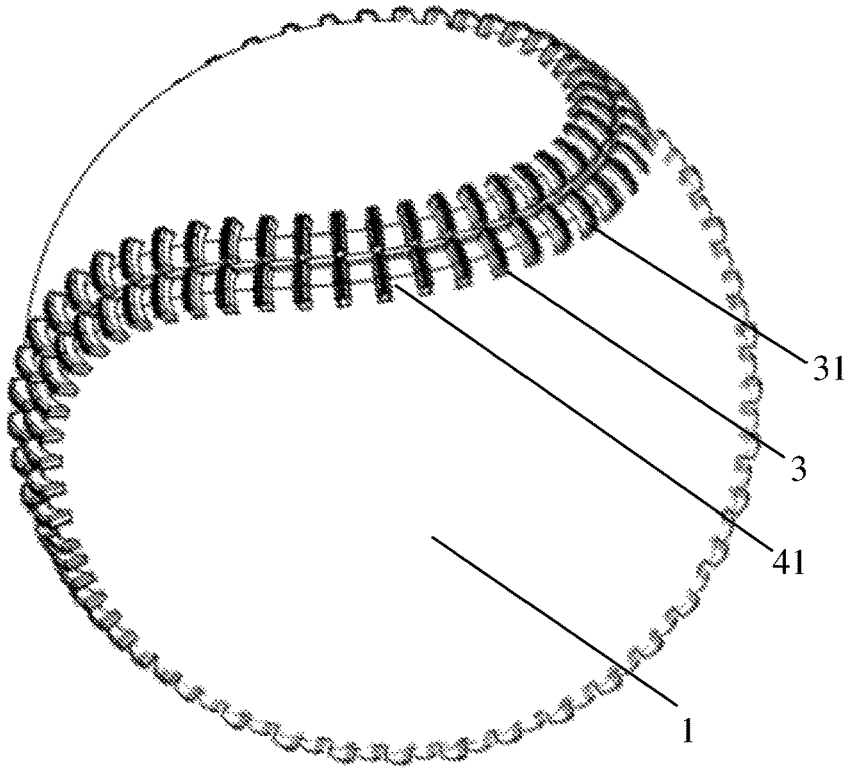
FIG. 6, a wrapping layer ball having a corresponding adhesion with a plane ball leather with a toothed edge.

As shown in FIG. 5 and FIG. 6, the raised lines of baseball/softball stitches on the wrapping layer have two forms.

One form is as shown in FIG. 6, the baseball/softball stitch guide 3 on the wrapping layer has stitch guide leaves 31 higher than the adhesion position of the ball leather, i.e., the position 41 between the two adjacent stitch guide leaves 31 is in the same plane with the wrapping layer 1 and the leaf stitch number of such stitch guide leaves 31 is generally designed to be 88, 104 or 108;

the other form of the wrapping layer is as shown in FIG. 5, wherein the stitch guide strip 2 on the wrapping layer 1 is of a strip shape with an arc edge, the strip-shaped stitch guide strip 2 is higher than the wrapping layer 1 at the adhesion position of the ball leather at the arc edge, the stitch guide leaves 21 on the strip-shaped stitch guide strip 2 is slightly higher than the stitch guide strip 2, and the leaf stitch number of the stitch guide leaves 21 is generally designed to be 88, 104 or 108;

The baseball/softball stitch guide integrally molded with the wrapping layer represents the meaning of the baseball stitches, which vividly shows the characteristics of the baseball and is used for the alignment effect when the leather is adhered. The baseball/softball stitch guide can be used in their own colors without a coloration treatment; or the baseball/softball stitch guide has a color of the wrapping layer material after being subjected to a color adjustment and molding; it can also be colored by spray-coating or printing, the spray-coated or printed baseball/softball stitch guide can be adjusted to a hand feel of that of a stitching effect from a traditional baseball, which is more verisimilar. The baseball/softball stitch guide is integrally molded, effectively avoiding the case where the stitch fracture due to speed and fraction results in the separation of the ball leather from the ball core, thus causing scrapping.

For the ball leather:

The ball leather can be made of a traditional genuine leather or an artificial leather (such as a PVC leather). For the ball leather form, a paperboard is cut according to the area and appearance of the ball core and fit adhesion test, and then a cutting die is manufactured. A corresponding paperboard and a cutting die are made for different ball cores and different machine pressures. Then a cutting machine is used for a process for punching a ball leather, so as to form a ball leather for adhering on the wrapping layer.

Figure 2:
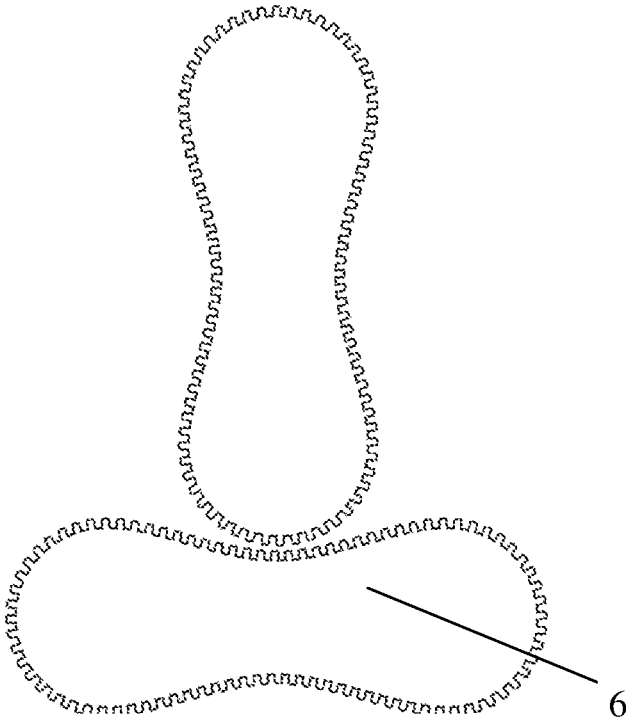
FIG. 2, a plane ball leather with a toothed edge.
Figure 4:
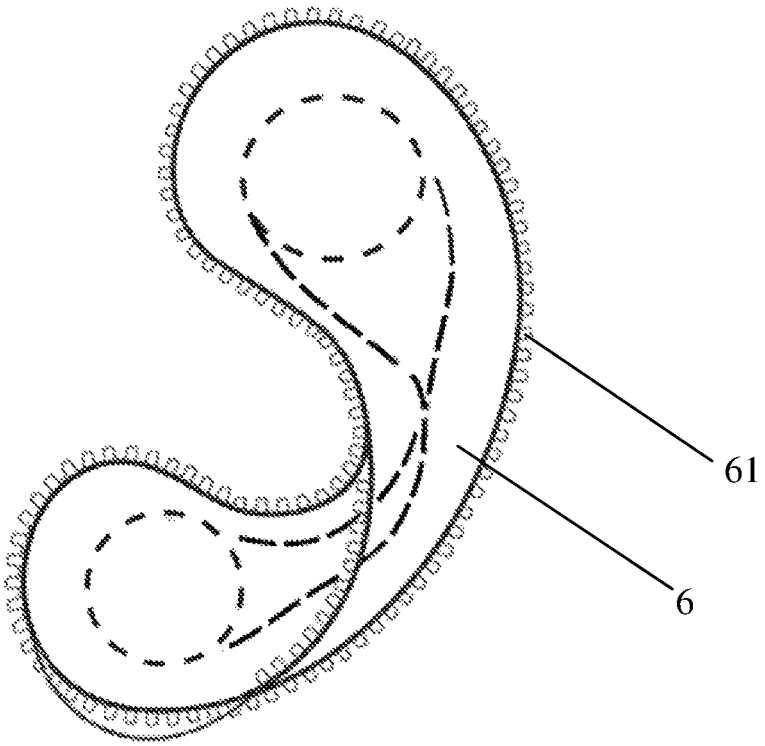
FIG. 4, a ball shape formed by suction-molding a plane ball leather with a toothed edge.

FIG. 4 shows a plane ball sheet corresponding to the wrapping layer 1 shown in FIG. 6, and the ball leather 6 shown in FIG. 2, the form of the ball leather 6 (i.e., the form of the ball leather 6) can be matched with the stitch guide 3, such that a leather-adhered baseball/softball with a toothed edge 61 is attached, the concave and convex edges of such a ball leather 6 with a toothed edge 61 and the stitch guide leaves 31 can be inserted and fitted with each other to have a mesh effect, the stitch guide leaves 31 are just in the concave portions of the toothed edge 61 of the ball leather 6, and the stitch guide leaves 31 of the wrapping layer 1 are higher than the adhesion position of the ball leather 6. The convex portions of the toothed edge 61 of the ball leather are just in the portions between the two adjacent stitch guide leaves 31, and the portions of the two adjacent stitch guide leaves 31 are in the same plane with the wrapping layer 1 under the ball leather 6 except the stitch guide. The number of the concave portions in the concave-convex edges of the toothed edge 61 of the ball leather is just the same as the leaf stitch number of the stitch guide leaves 31, after the insertion and fitting, an appearance shape of the engagement of the stitch guide leaves 31 of a leather-adhered baseball/softball toothed shape with the concave portions of the ball leather 6 having toothed edges 61 is formed.

Corresponding to the wrapping layer shown in FIG. 5, another form of the ball leather 5 is provided, and the edge form of the ball leather 5 may be an arc edge shape. When the ball leather 5 is adhered, the ball leather 5 completely wraps the portion except the strip-shaped stitch guide strip 2. The strip-shaped stitch guide strip 2 is slightly higher than the wrapping layer 1 at the ball leather adhesion position, and when the ball leather 5 is adhered, the strip-shaped stitch guide strip 2 is then in the same plan with the ball leather 5, except the stitch guide leaves 21 portion; however, the stitch guide leaves 21 on the stitch guide strip 2 is higher than the stitch guide strip 2, resulting in an appearance shape of the engagement of the strip-shaped stitch guide strip 2 in the leather-adhered baseball with the ball leather with an arc edge.

When the ball leather is adhered, for a more even and smooth adhesion, the ball leather is adhered onto the wrapping layer of the ball core in two or more pieces of ball leather. When the number of the ball leather pieces is relatively small, for example, 4 pieces, 3 pieces or 2 pieces, the ball leather is adhered by leather extension under the effects of an adhesive and a pressure, after the ball leather is expanded by a tool.

For the adhesive:

The adhesive has a function of an effective bonding, fusion or meshing between the wrapping layer and the ball leather. A suitable adhesive material can be selected according to different wrapping layers and ball leather materials, for example, for a rubber wrapping layer and a PVC ball leather, a resin adhesive is selected; for example, for a PU wrapping layer and a PVC ball leather, a PU adhesive is selected. The most suitable adhesive material matching depends on the wrapping layer and the ball leather materials.

The resin adhesive is mainly made of a resin, a softening oil, zinc oxide, DM (i.e., diphenylthiazolium disulfide), and sulfur. The PU adhesive can be an existing PU adhesive or a house-made formulated PU adhesive, as long as the PU adhesive, when being used for adhering the ball leather to the wrapping layer, has an adhesive effect which allows the engagement or fusion of the ball leather and the wrapping layer.

The adhesive formulation can be adjusted for different ball leathers and wrapping layers. The formulation can be adjusted depending the weather according to the requirements, with respect to the amount, material replacement, to achieve the standard requirements of a high hardness and resilience, such as a good shape, less bubbles, yellowing resistance and aging resistance.

For the adhesion method:

An adhesive layer can be applied to the outside of the wrapping layer, and the ball leather is accurately fixed and adhered onto the wrapping layer of the ball core following the location of a jig in an oil pressing process; the oil press is adjusted to the most suitable threshold temperature and pressure such that the ball leather is embedded into the wrapping layer, a complete fusion of the two is obtained. The oil press can also be adjusted to a suitable low threshold temperature such that the ball leather and the wrapping layer are let to be engaged with each other.

The ball leather can also be fixed and adhered onto the wrapping layer by another mold, followed by vulcanization fusion in a vulcanizer, such that the adhesive forms a vulcanization melt layer for melt-adhering the wrapping layer and the ball leather, and then the finished product is removed from the mold. The adhesive in such a case can be a resin adhesive, which has the main components: a resin, a softening oil, zinc oxide, DM (i.e., diphenylthiazolium disulfide), and sulfur. In such a case, a resin such as a petroleum resin or a coumarone resin is used as a softening agent; DM, as a vulcanization accelerator, promotes the vulcanization reaction, shortens the vulcanization time, lowers the vulcanization temperature, and reduces the amount of sulfur; zinc oxide, as a vulcanization activator, can increase the activity of the vulcanization accelerator and improve the vulcanization efficiency; sulfur is used as a vulcanizing agent.

For the ball cover:

The circumference and the weight of the ball cover are adjusted dependent on the circumference of and the weight of the ball core, for example: the weight requirements of the finished product is a standard of 145 g±3 g (142-148 g) and the circumference is required to be between 8.75 and 9.25 inches; when the ball core molded with the wrapping layer is set to 120 g, the ball cover should be set at 25 g±3 g, circumferentially and so on, to set the weight and circumference of the ball cover.

The process for manufacturing a leather-adhered baseball/softball is further explained herebelow. Of course, the manufacturing process in the present patent document may also be referred to as a preparation process or a production process.

A method for manufacturing a leather-adhered baseball/softball, comprising the steps of: placing the ball core and the wrapping layer materials into a mold for shaping, wherein the mold is engraved with raised lines of the baseball/softball stitches, so as to form a wrapping layer wrapping the ball core, the wrapping layer has a raised baseball/softball stitch guide, applying an adhesive to the wrapping layer, then aligning and adhering the ball leather onto the wrapping layer except the baseball/softball stitch guide, then leaving same to stand and adhering or placing same into another mold or jig for shaping and then removing same.

In such a case, placing into another mold or jig for processing and shaping can be carried out according to the steps as illustrated in the above adhesion method. The entire manufacturing method can be refined by referring to the description of each part of the above-mentioned leather-adhered softball and baseball.

Test results in comparative experiment:

The leather-adhered baseball/softball prepared in the present invention is superior to the traditional softball and baseball in terms of the service life, compression resistance, number of hits, COR, and bounce coefficient.

The leather-adhered baseball/softball of the present invention has the following advantages:

1. The present invention overcomes the comprehensive shortcomings of a traditional baseball/softball, such as the manual processing difficulty and the quality control difficulty, uses an adhesion method instead of the hand stitching method, and can also effectively achieve a perfect adhesion of the ball leather onto the wrapping layer, replacing the stitching processing of the ball cover from an original traditional leather material by manual stitching, as well as the ball cover material, thereby overcoming the shortcomings of an extremely low output by the manual production and difficulties in recruitment and training, such that the output is improved and the quality is stable.

2. The present invention further allows the quality required by the product function coefficient to be more stable on the basis of high productivity, and even improves the functional quality and the number of hits of the product, and has the traditional baseball/softball characteristics in the functional coefficients such as the sense of smell, the hand feel and the resilience, and at the same time the consumers can get the high quality and inexpensive baseball/softball.

3. The baseball/softball of the invention has an added wrapping layer on the boll core, such that when the ball leather is adhered, the bonding between the ball leather and the wrapping layer is stronger and smoother, effectively preventing some uneven ball core surface, thus largely avoiding the effect on the quality and service life of the ball leather resulting from the appearance of air bubbles in the ball cover. Moreover, the specific baseball/softball stitch guide can be formed by engraving the mold with raised lines, and the baseball/softball stitch guide also allows an effective alignment of the adhesion of the ball leather; as a result, the ball is more similar to a traditional baseball in appearance, the ball leather and the ball core are better adhered functionally, and moreover, the wrapping layer has moisture-proof and anti-corrosive effects on the ball core.

4. The baseball/softball stitch guide on the wrapping layer of the ball core is integrally molded, which can effectively avoid: broken thread results from the friction or speed, when a traditional baseball is played, thus effectively avoiding that if the hand thread is broken, the ball leather will be separated from the ball core, then this baseball/softball is also scrapped, so the leather-adhered baseball/softball has a superior service life than a traditional baseball/softball.

5. The present leather-adhered baseball/softball, with respect to a traditional baseball/softball, has an added wrapping layer, and the leather-adhering on the wrapping layer replacing the original stitching process, the baseball softball stitch guide molded integrated with a wrapping layer replacing the stitching thread, such that the whole product is superior to a traditional baseball/softball, in terms of a stick and unsmooth hand feel, as well as product features, such as resilience, compression resistance and the number of hits. The present leather-adhered baseball/softball has a longer service life, the effect of a traditional baseball/softball in the sense of smell, touch and vision, superior performance and a better use effect.

The present invention is to solve the problem that after the ball leather has been plane-cut it has a certain hardness and is in a plane state, it is difficult to perform a 360-degree spherical arc surface adhesion with the 3D spherical ball wrapping layer, resulting in ball leather edge wrinkles, as a result, the direct adhesion and the adhesion effects are poor. Therefore, in the present invention, after a ball leather is cut out of a plane leather, for example the two different forms of plane ball leathers 5, as shown in FIGS. 1 and 2; the ball leather 5 will be 5 mm more than the side width during the adhesion, the plane ball leather is placed into a device with a high-frequency mold having a heating function and a suction mold, wherein the high-frequency and suction molds are developed and mold according to the size and shape of the wrapping layer ball to meet the most match of the ball leather form state during the engagement of the ball leather and the stitch guide strip; in order to shape the flat ball sheet into a spherical shape, and the high-frequency cutting is to remove an additional 5 mm edge width which is produced from shrinking when the ball leather is heated and shaped.

Figure 3:
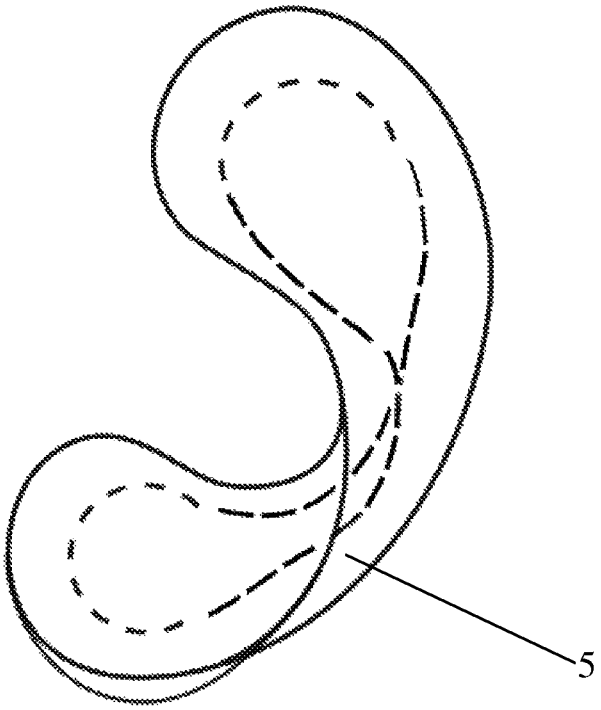
FIG. 3, a ball shape formed by suction-molding a plane ball leather with an arc edge.

First suction molding the ball leather 5 is separately molded on the suction mold for positioning;

then high frequency treatment: then, the suction molded ball leather 5 is placed on the heating high-frequency mold for shaping, after controlling the ball surface shape with a complete match between the ball leather and the wrapping layer ball, the high-frequency treatment is performed at the same time to remove the edge width resulting from the compression and deformation by heating the ball skill at a high temperature, as shown in FIG. 3 and FIG. 4; in such a case, FIG. 3 corresponds to a state, with the plane ball leather 5 in FIG. 1 being suction-molded, FIG. 4 corresponds to a state, with the plane ball leather 6 in FIG. 2 being suction-molded.

After the suction molding and high frequency treatment, the ball leather with a spherical shape is adhesive-sprayed, and the ball leather and the wrapping layer ball can be directly adhered by hands, after the adhesion, same is placed into a hot pressing mold for an adhesive-fusion and thermal bonding pressing at a high temperature, and then the ball is removed from the mold; it is also possible to place two ball leathers in the upper and lower molds of the hot pressing mold separately, and then the wrapping layer ball is placed into the mold; after the mold clamping, the high temperature adhesive-fusion and thermal bonding pressing are carried out, and then the ball is removed from the mold.

In the present invention, the ball leather can also be aligned and molded on the wrapping layer except the baseball/softball stitch guide by a formulated leather raw material by a mold, so as to form a ball cover having said baseball/softball stitch guide. The main raw material of leather is generally made of polyvinyl chloride, polyurethane, polyamide, polyolefin, various additives, color pastes and fillers, which are added to a vertical mixer at the proportion of the formulation, such that the components are homogeneously distributed in the material, and a compound is prepared. The ball leather is directly formed on the wrapping layer by the production procedures of leather rubber preparation, mold injection, gelation, a surface treatment, embossing, and cold cutting.

After the leather raw material is injected into the ball leather molding chamber containing the wrapping layer ball, the mold is turned over to ensure that the leather material is fully filled into the entire molding chamber. Then same is put into a plasticizing box and oven for heating, plasticized or foamed under the action of a high temperature, and then removed out from the oven, cold-cut and removed out from the mold, and a finished product is obtained. The ball surface layer formed from the leather rubber has a high-density self-leather formation layer. The ball leather formed by injecting a raw leather slurry into a ball leather mold has the same hand feel as a leather and is wear resistance. The ball leather made of a formulation with a foaming agent has a fullness hand feel and is elastic. At the same time, it is wear-resistant, cold-resistant, waterproof and sun-resistant. The leather face can have an imitation leather grain surface and various embossing pattern effects under the mold.

In such a case, the leather raw material may also be in a solid; according to the formulation requirements, various components are put into a kneading machine and mixed uniformly, then is subjected to mastication by an internal mixer, an open mill and an extruder, and then sent to a calender for calendering into leather material leather sheets with a desired ball leather thickness, then sent to the ball leather mold, followed by heating and cold cutting to obtain the leather piece. In order to improve the adhesion of the ball leather and the wrapping layer of the ball core, a layer of an adhesive is often applied to the wrapping layer.

The detailed descriptions set forth above are merely specific descriptions directed to the feasible embodiments of the present invention, and they are not intended to limit the scope of protection of the present invention; any equivalent embodiment or alteration of the present invention made without departing from the technical spirit of the present invention, shall be included within the scope of protection of the present invention.

The invention claimed is:

1. A leather-adhered baseball/softball, comprising a ball core, wherein a wrapping layer is formed over the ball core by a mold, wherein the mold is engraved with raised lines of baseball/softball stitches, such that the molded wrapping layer has a raised baseball/softball stitch guide; the baseball/softball stitch guide is used to align a ball leather, such that the ball leather is aligned and adhered onto the wrapping layer except the baseball/softball stitch guide by an adhesive, so as to form a ball cover having the baseball/softball stitch guide;

wherein the baseball/softball stitch guide on the wrapping layer has stitch guide leaves higher than an adhesion position of the ball leather, and a portion between two adjacent stitch guide leaves is in a same plane with the wrapping layer; the stitch guide leaves have a leaf stitch number of 88, 104 or 108.

2. The leather-adhered baseball/softball according to claim 1, wherein the baseball/softball stitch guide has a color of the wrapping layer material after being subjected to a color adjustment and molding, or is colored by spray coating or printing.

3. The leather-adhered baseball/softball according to claim 1, wherein the material of the wrapping layer is a rubber material, and the wrapping layer is formed by wrapping over the mold using an oil press or a vulcanizer; or the material of the wrapping layer is a PU material, and the wrapping layer is formed by integral perfusion on the mold by a perfusion machine; or the material of the wrapping layer is a PVC, TPR, TPU, silica gel or EVA material, and the wrapping layer is formed by injecting molding on the mold by an injection molding machine.

4. The leather-adhered baseball/softball according to claim 1, wherein the adhesive is applied to the outside of the wrapping layer, and the ball leather is adhered onto the wrapping layer following the location of a jig in an oil pressing process; the oil press is adjusted to a threshold temperature and pressure such that the ball leather is embedded into the wrapping layer, until a complete fusion of the two is obtained; or the oil press is adjusted to another low threshold temperature such that the ball leather and the wrapping layer are let to be engaged with each other.

5. The leather-adhered baseball/softball according to claim 1, wherein the adhesive is applied to the outside of the wrapping layer, and the ball leather is fixed and adhered onto the wrapping layer by another mold, followed by vulcanization fusion in a vulcanizer, such that the adhesive forms a vulcanization melt layer for melt-adhering the wrapping layer and the ball leather.

6. The leather-adhered baseball/softball according to claim 1, wherein the ball core is a rubber core, a PU core, a PVC core, a wood core or a ball core made of a mixture of different materials, or a ball core formed from a plurality of wound layers of wool, cotton or wires of different materials.

7. The leather-adhered baseball/softball according to claim 1, wherein the ball leather is adhered onto the wrapping layer in two or more pieces; or when the number of the ball leather pieces is relatively small, the ball leather is adhered by means of leather expansion.

8. The leather-adhered baseball/softball according to claim 1, wherein the material of the ball leather is a genuine leather or artificial leather, and the ball leather is punched by a cutting machine to form a ball leather for adhering to the wrapping layer.

9. The leather-adhered baseball/softball according to claim 1, wherein the ball leather has a toothed edge, and concave and convex edges of the toothed ball leather edge and the stitch guide leaves are inserted into and fitted with each other; the stitch guide leaves are inserted into the concave portions of the toothed edge of the ball leather, and the stitch guide leaves of the wrapping layer are higher than the adhesion position of the ball leather; the convex portions of the toothed edge of the ball leather are inserted into the portions between the two adjacent stitch guide leaves, and the portions between the two adjacent stitch guide leaves are in the same plane with the wrapping layer under the ball leather except the stitch guide; the number of the concave portions in the concave-convex edges of the toothed edge of the ball leather is the same as the leaf stitch number of the stitch guide leaves.

10. The method for manufacturing a leather-adhered baseball/softball according to claim 1, wherein the method comprises the steps of:

placing the ball core and the wrapping layer materials into a mold for shaping, wherein the mold is engraved with raised lines of the baseball/softball stitches, so as to form a wrapping layer wrapping the ball core, the wrapping layer has a raised baseball/softball stitch guide;

applying an adhesive to the wrapping layer, then aligning and adhering the ball leather onto the wrapping layer except the baseball/softball stitch guide; and, then leaving same to stand and adhering or placing same into another mold or jig for shaping and then removing same.

* * * * *